US011332873B2

(12) United States Patent
Jung et al.

(10) Patent No.: US 11,332,873 B2
(45) Date of Patent: May 17, 2022

(54) LAUNDRY TREATING APPARATUS

(71) Applicant: LG Electronics Inc., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 108 days.

(21) Appl. No.: 16/749,592

(22) Filed: Jan. 22, 2020

(65) Prior Publication Data

US 2020/0232147 A1 Jul. 23, 2020

(30) Foreign Application Priority Data

Jan. 22, 2019 (KR) ..... 10-2019-0008283

(51) Int. Cl.

| | |
|---|---|
| ***D06F 39/02*** | (2006.01) |
| ***D06F 39/08*** | (2006.01) |
| ***D06F 37/28*** | (2006.01) |
| *D06F 105/42* | (2020.01) |
| *D06F 21/04* | (2006.01) |

(52) U.S. Cl.

CPC ..... *D06F 39/02* (2013.01); *D06F 37/28* (2013.01); *D06F 39/088* (2013.01); *D06F 21/04* (2013.01); *D06F 2105/42* (2020.02)

(58) Field of Classification Search

None

See application file for complete search history.

(56) References Cited

U.S. PATENT DOCUMENTS

2011/0277515 A1* 11/2011 Doh ..... D06F 39/022 68/17 R
2017/0107656 A1* 4/2017 Kim ..... D06F 39/022
2017/0233936 A1 8/2017 Doyle et al.
2019/0345660 A1* 11/2019 Nam ..... D06F 39/022

OTHER PUBLICATIONS

Office Action in German Appln. No. 102020200435, dated Dec. 7, 2021, 30 pages (with English translation).

* cited by examiner

*Primary Examiner* — Cristi J Tate-Sims

(74) *Attorney, Agent, or Firm* — Fish & Richardson P.C.

(57) ABSTRACT

The present disclosure relates to a laundry treating apparatus, including a tub provided inside a main body and a drum rotatably provided inside the tub; and a detergent supply apparatus configured to supply laundry detergent to the tub, and provided to be inserted into or withdrawn from a front surface of the main body, wherein the detergent supply apparatus includes a housing defining an outer appearance; a storage container disposed to extend in a front-rear direction of the main body to store the laundry detergent, and mounted to the housing; and a laundry detergent pump provided at one side of the storage container, and configured to suck laundry detergent stored in the storage container, and then to discharge the laundry detergent to a lower side of the housing.

11 Claims, 10 Drawing Sheets

LAUNDRY TREATING APPARATUS

CROSS-REFERENCE TO RELATED APPLICATION

Pursuant to 35 U.S.C. § 119(a), this application claims the benefit of an earlier filing date of and the right of priority to Korean Patent Application No. 10-2019-0008283, filed on Jan. 22, 2019, the contents of which are incorporated by reference herein in its entirety.

BACKGROUND

1. Technical Field

The present disclosure relates to a laundry treating apparatus having a detergent supply apparatus.

2. Description of the Related Art

The laundry treating apparatus is an apparatus for putting clothing, bedding or the like (hereinafter, referred to as laundry) into the drum to remove contamination from the laundry. The laundry treating apparatus may perform the processes of washing, rinsing, dehydrating, drying and the like, and the laundry treating apparatus may be divided into a top loading type and a front loading type based on a method of putting laundry into a drum.

The laundry treating apparatus may generally include a main body defining an outer appearance, a tub received into the main body, a drum rotatably mounted inside the tub to put laundry thereinto, and a detergent supply apparatus for supplying detergent into the drum. When the drum is rotated by the motor while wash water is supplied to the laundry received in the drum, dirt adhered to the laundry may be removed by a friction with the drum and the wash water.

The detergent supply apparatus is provided with a laundry detergent supply function of supplying detergent or laundry detergent (hereinafter, referred to as "laundry detergent") to enhance the washing effect.

Here, the laundry detergent means a substance that enhances the washing effect, such as textile detergent, fabric softener, and fabric bleach. For the laundry detergent, powder type laundry detergent or liquid type laundry detergent may be used.

In recent years, there is a problem in that the detergent component is not dissolved after washing and remains in the water tank or the laundry due to its relatively insufficient solubility, and thus, the use of liquid laundry detergent with excellent solubility is increased.

A laundry treating apparatus in the related art has inconvenience because it is mainly used a method of allowing the user to open a door and then to manually put laundry detergent in a detergent storage container provided inside the door so as to supply the laundry detergent and then to add the laundry detergent directly injected by the user to the tub by way of water supplied through a water passage.

SUMMARY

A first aspect of the present disclosure is to provide a structure of a laundry treating apparatus having a detergent supply apparatus capable of automatically supplying laundry detergent to a drum, and being conveniently used by a user.

A second aspect of the present disclosure is to provide a structure of a laundry treating apparatus capable of reducing a front-rear length of the detergent supply apparatus, and having a simple structure at a rear portion of the detergent supply apparatus.

A third aspect of the present disclosure to provide a structure of a laundry treating apparatus capable of further facilitating the input of laundry detergent, and supplying laundry detergent to a position adjacent to a detergent input hole and a tub.

In order to achieve an object of the present disclosure, a laundry treating apparatus having the foregoing structure may include a tub provided inside a main body and a drum rotatably provided inside the tub; and a detergent supply apparatus configured to supply laundry detergent to the tub, and provided to be inserted into or withdrawn from a front surface of the main body, wherein the detergent supply apparatus includes a housing defining an outer appearance; a storage container disposed to extend in a front-rear direction of the main body to store the laundry detergent, and mounted to the housing; and a laundry detergent pump provided at one side of the storage container, and configured to suck laundry detergent stored in the storage container, and then to discharge the laundry detergent to a lower side of the housing.

According to an example of the present disclosure, the detergent supply apparatus may further include a wash water dispenser fixedly provided inside the main body to allow a bottom surface thereof to be located to face an upper portion of the storage container when the housing is mounted to the main body so as to define a moving path of wash water flowing in from the outside.

According to an example of the present disclosure, the laundry detergent pump may include a motor assembly provided at one upper side of the wash water dispenser; and a pump module configured to generate a movement of laundry detergent stored in the storage container by an external force transmitted by the motor assembly.

According to an example of the present disclosure, the motor assembly may include a case having a space defined therein and a motor provided inside the case to generate a rotational force; a direction change gear provided to engage with a rotation shaft of the motor to change a direction of the rotational force; a reduction gear configured to rotate in engagement with the teeth of the direction change gear; and a crankshaft, one end of which is fixedly provided at the reduction gear to generate a reciprocating motion of a cam head coupled to one side thereof by a rotational force generated by the reduction gear.

According to an example of the present disclosure, the laundry treating apparatus may include a vertical movement member provided at a lower portion of the cam head to enable vertical movement while in contact with a lower end portion of the cam head, wherein the pump module is pressurized by the vertical movement of the vertical movement member.

According to an example of the present disclosure, the pump module may include a first cylinder defined in a cylindrical shape, and located to be received in the storage container, and a second cylinder disposed in parallel to the first cylinder, one side of which communicates with the first cylinder to receive laundry detergent flowing in along the first cylinder and discharge the laundry detergent to a lower portion of the housing.

According to an example of the present disclosure, a sliding plate elastically supported by a first spring may be provided inside the first cylinder, and the sliding plate may move laundry detergent received in the first cylinder toward the second cylinder while moving downward when the pump module is pressurized by the vertical movement member.

According to an example of the present disclosure, a second valve member provided inside the second cylinder may open a passage to move laundry detergent while moving downward.

According to an example of the present disclosure, the sliding plate may move a first valve member provided in the first cylinder upward while being moved upward by the first spring when pressurization due to the vertical movement member is removed.

According to an example of the present disclosure, a first storage container and a second storage container may be mounted to face each other at one side of the housing, and a manual detergent dispensing unit may be disposed between the first and second storage containers to allow a user to manually put laundry detergent therein.

According to an example of the present disclosure, a third storage container configured to guide the input of laundry detergent by the user may be mounted to the manual detergent dispensing unit.

According to an example of the present disclosure, a lower surface portion of the housing may be disposed to be inclined to move the laundry detergent, and a detergent input hole may be disposed at a lower surface of the housing to communicate with the tub.

According to an example of the present disclosure, a discharge port may be disposed at a rear portion of the storage container to discharge laundry detergent stored by the operation of the laundry detergent pump, and laundry detergent flowing out through the discharge port may be mixed with incoming wash water to move to the tub.

The effects of the present disclosure obtained through the above-described solutions are as follows.

First, a driving force of the motor assembly constituting the detergent supply apparatus may be transmitted to the pump module, and an appropriate amount of laundry detergent may be supplied to the tub by the pump module, thereby further enhancing the user's convenience.

Second, the motor assembly and the pump module of the detergent supply apparatus may be vertically disposed to reduce a front-rear length of the detergent supply apparatus, and an additional movement pipe for moving laundry detergent may not be required to provide a simple structure, thereby allowing the simplification of manufacturing process and the reduction of cost.

Third, through the driving of the pump module, the input of laundry detergent may be simply implemented, and a movement path of laundry detergent may be simplified, thereby quickly supplying laundry detergent.

DETAILED DESCRIPTION OF THE EMBODIMENTS

Hereinafter, a laundry treating apparatus associated with the present disclosure will be described in more detail with reference to the accompanying drawings.

According to the present specification, the same or similar elements are designated with the same numeral references even in different embodiments and their redundant description will be omitted.

Furthermore, a structure applied to any one embodiment may be also applied in the same manner to another embodiment if they do not structurally or functionally contradict each other even in different embodiments.

A singular representation may include a plural representation as far as it represents a definitely different meaning from the context.

In describing the embodiments disclosed herein, the detailed description will be omitted when specific description for publicly known technologies to which the invention pertains is judged to obscure the gist of the present disclosure.

It should be understood that the accompanying drawings are merely illustrated to easily explain the concept of the invention, and therefore, they should not be construed to limit the technological concept disclosed herein by the accompanying drawings, and the concept of the present disclosure should be construed as being extended to all modifications, equivalents, and substitutes included in the concept and technological scope of the invention.

Figure 1:
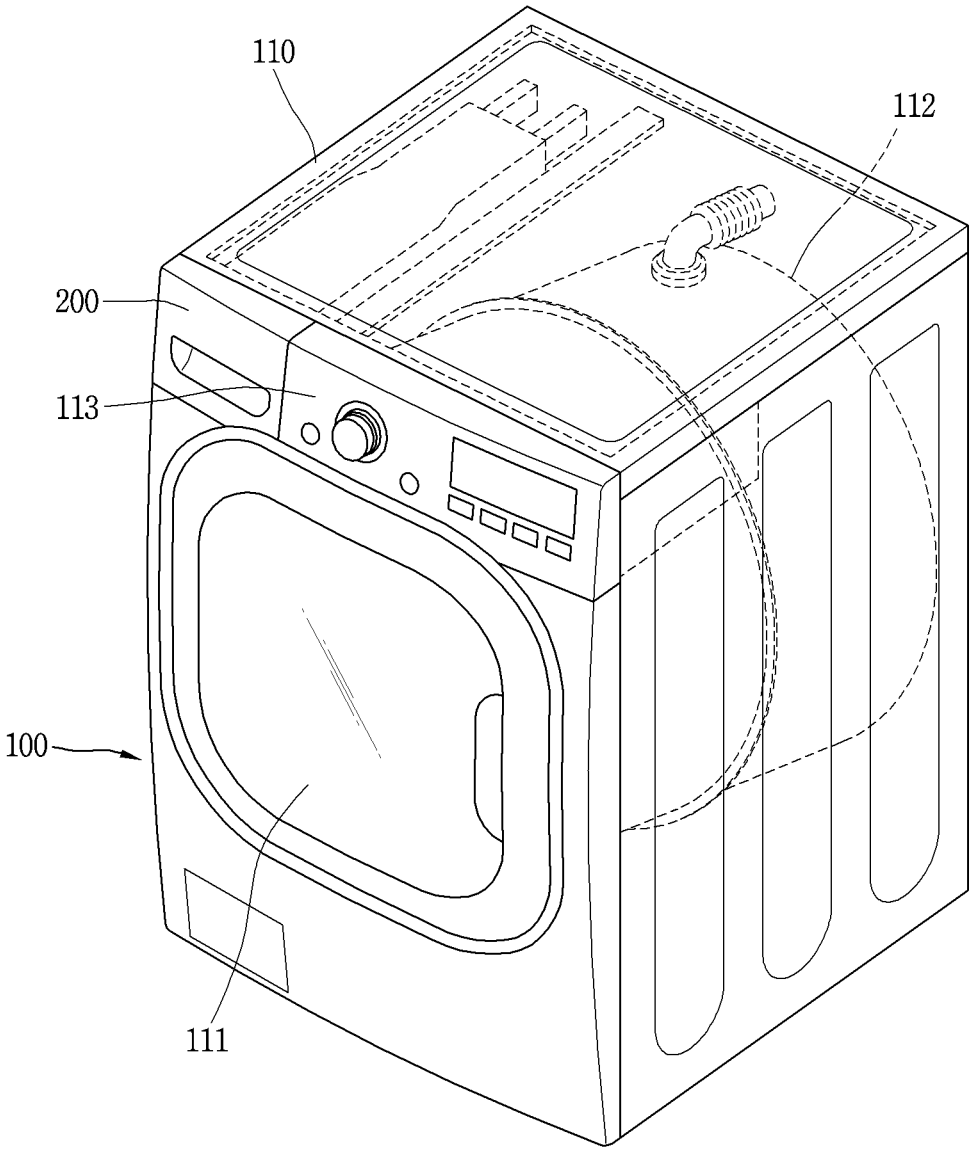
FIG. 1 is a perspective view illustrating a laundry treating apparatus according to the present disclosure.

FIG. 1 is a perspective view illustrating a laundry treating apparatus according to the present disclosure.

The laundry treating apparatus 100 may include a washing machine for inserting fabric into a washing tub to perform washing, rinsing, dehydration, and the like and a dryer for inserting wet fabric to perform drying.

The laundry treating apparatus may be divided into a top load type and a front load type. FIG. 1 illustrates a front load type laundry treating apparatus, for the sake of convenience of explanation, and the technical concept of the present disclosure may not be applicable only to a front load type washing machine, and thus may also be applicable to a top load type washing machine.

As shown in FIG. 1, the laundry treating apparatus 100 has a structure including a main body 110 defining an outer appearance, an operation unit 113 that receives various control commands from a user and has a display unit displaying information on an operation state, and a door 111 rotatably provided at a front portion of the main body 110 to allow the entry and exit of laundry.

The main body 110 may define an outer appearance of the laundry treating apparatus 100, and may be provided with a space capable of receiving various components constituting the laundry treating apparatus 100 inside the main body 110. A drum 112 that receives laundry loaded through the door 111 may be provided inside the main body 110.

The drum 112 may include an outer tub (not shown) filled with wash water, and an inner tub (not shown) provided to be rotatable inside the outer tub (not shown) to receive laundry. One side of the drum 112 may be provided with a balancer (not shown) to compensate for eccentricity caused by rotation.

The operation unit 113 may include various keys for operating the operation state of the laundry treating apparatus 100 and a display for displaying the operation state of the laundry treating apparatus 100.

The door 111 is to open and close a fabric entrance hole, and may be made of a transparent member such as tempered glass to look inside the main body 110.

The laundry treatment apparatus 100 according to the present disclosure may further include a detergent supply apparatus 200.

The detergent supply apparatus 200 may be provided to be inserted into or withdrawn from one upper side of the main body 110. The detergent supply apparatus 200 may store laundry detergent having a broader concept including detergent and fabric softener to automatically supply the laundry detergent into the drum 112 in the washing process. Here, the laundry detergent denotes a material capable of enhancing the washing effect of laundry, and may denote liquid fabric detergent and liquid fabric softener.

Figure 2:
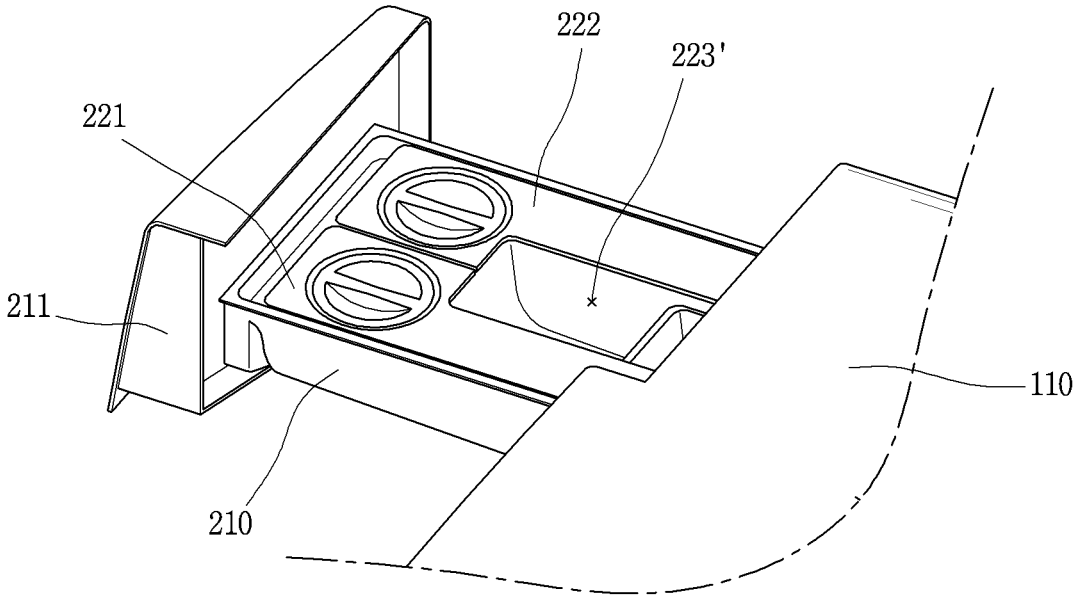
FIG. 2 is a conceptual view showing a state when a detergent supply apparatus is withdrawn from a main body.

FIG. 2 is a conceptual view illustrating a state in which the detergent supply apparatus 200 is withdrawn from the main body 110. The detergent supply apparatus 200 may include a housing 210 defining an outer appearance, and storage containers 221, 222 mounted to the housing 210. When the user grips a front portion 211 of the housing 210 and then pulls it out, the detergent supply apparatus 200 may be withdrawn out in a sliding manner from a front portion of the main body 110. Similarly, when the user pushes the front portion of the housing 210 toward the main body 110, the detergent supply apparatus 200 may be inserted into the main body 110 while sliding in a direction toward the main body.

However, in order for the user to withdraw the detergent supply apparatus 200 from the main body to replenish laundry detergent in the storage containers 221, 222 or to supply laundry detergent to a manual detergent dispensing unit 223', the plugs 224 of the storage containers 221, 222 and the manual detergent dispensing unit 223' must be made to be exposed to the outside when the detergent supply apparatus 200 is withdrawn from the main body.

The first storage container 221 and the second storage container 222 configured to store different laundry detergents may be mounted inside the housing 210. In addition, the manual detergent dispensing unit 223' manually supplying laundry detergent by a user may be disposed between the first storage container 221 and the second storage container 222.

The plugs 224 may be provided in the first storage container 221 and the second storage container 222, respectively. The plugs 224 may be removed from the storage containers 221, 222 when rotated in one direction. When the plugs 224 are removed from the storage containers 221, 222, the user will be able to supply laundry detergent to the storage containers 221, 222.

In other words, when a lack of laundry detergent is sensed on the operation panel 113 of the laundry treatment apparatus 100, the housing 210 is withdrawn out, and then the plugs 224 coupled to the storage containers 221, 222 exposed to the outside are gripped, and then removed by rotating them in one direction to replenish the laundry detergent in the storage containers 221, 222.

Figure 3A:
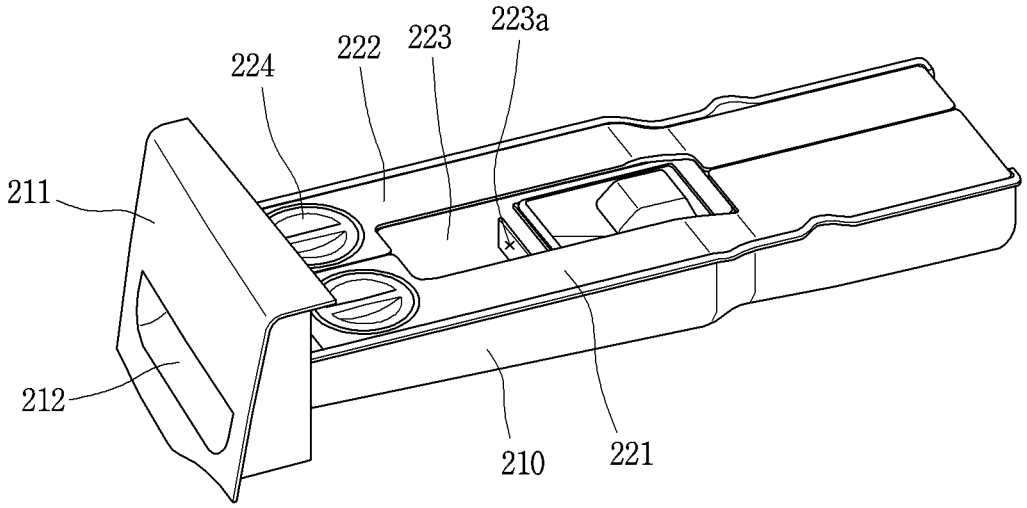
FIG. 3A is a perspective view showing a state in which the detergent supply apparatus is completely withdrawn out to the outside.
Figure 3B:
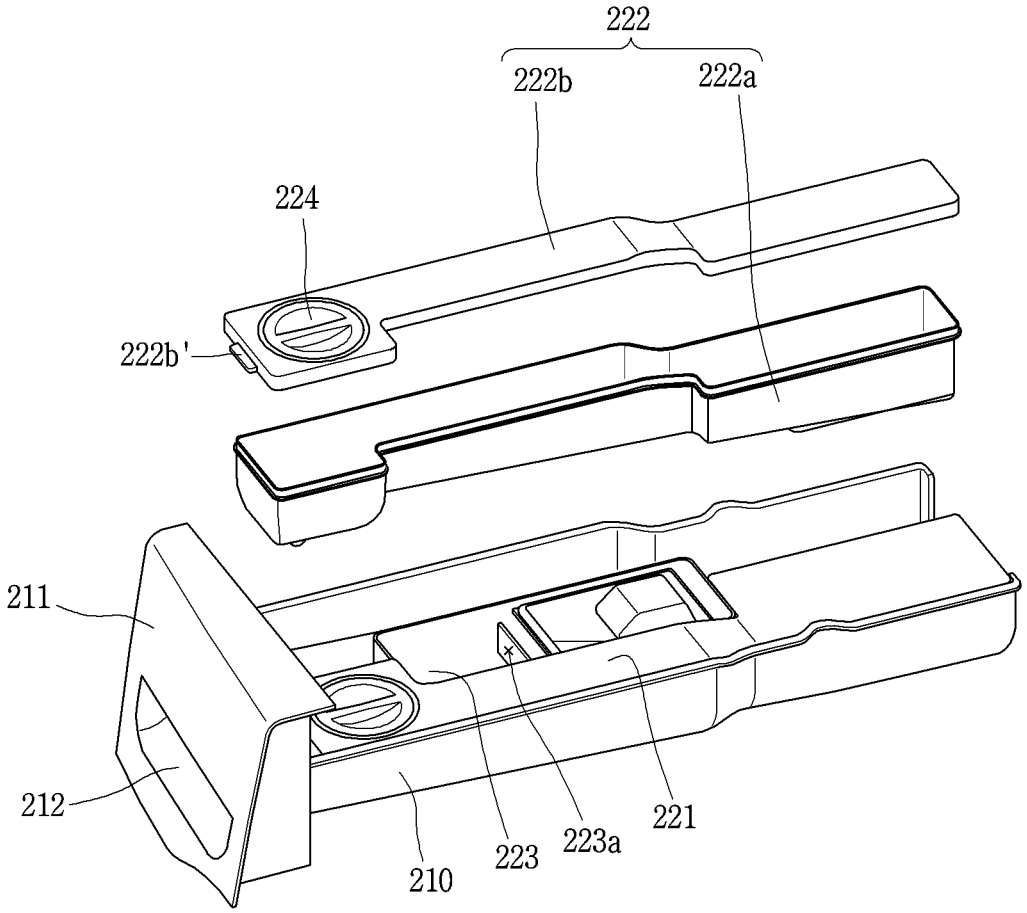
FIG. 3B is an exploded perspective view of the detergent supply apparatus in FIG. 3A.

FIG. 3A is a perspective view showing a state in which the detergent supply apparatus is completely withdrawn out to the outside, and FIG. 3B is an exploded perspective view of the detergent supply apparatus in FIG. 3A.

The detergent supply apparatus 200 may be made to be withdrawn from or inserted into the main body 110 by the user. When the user grips the front portion 211 of the housing 210 and then pulls it out, the detergent supply apparatus 200 may be withdrawn out while sliding from the front part of the main body 110. When the detergent supply apparatus 200 is withdrawn from the main body 110, the storage containers 221, 222 may be exposed to the outside.

detergent supply apparatus 200 may include a housing 210 defining an outer appearance, and storage containers 221, 222 mounted to the housing 210.

The housing 210 defines an outer appearance of the detergent supply apparatus 200, and may be defined in a shape that is open at an upper end thereof. The housing 210 may be defined in a shape extending in a front-rear direction of the main body 110, and a plurality of storage containers 221, 222 may be mounted in a receiving space defined inside the housing 210.

The storage containers 221, 222 may include a first storage container 221 and a second storage container 222. The first storage container 221 and the second storage container 222 may be defined in a shape of a container extending in a front-rear direction of the main body 1110, and provided with a space capable of storing a predetermined amount of laundry detergent therein.

The first storage container 221 and the second storage container 222 may be defined in a "ㄷ"-shape, and the first storage container 221 and the second storage container 222 may be mounted inside the housing 210 in a shape facing each other.

Different laundry detergents may be stored inside the first storage container 210 and the second storage container 220. For example, fabric softener may be stored in the first storage container 210 and liquid detergent may be stored in the second storage container 220, respectively.

A lower surface of the first storage container 221 and the second storage container 222 may be disposed have a predetermined inclination, thereby facilitating the flow of the laundry detergent received in each of the storage containers 221, 222. The laundry detergent stored in each of the storage containers 221, 222 must be supplied toward the tub through the laundry detergent pump 300, it may be disposed to be inclined with a constant inclination toward the rear side.

Each of the storage containers 221, 222 may include a receiving portion 221*a*, 222*a* in which laundry detergent is received and a storage container lid portion 221*b*, 222*b* configured to cover each receiving portion 221*a*, 222*a* to limit an external exposure of the laundry detergent. Furthermore, the storage container lid portion 221*b*, 222*b* may be provided with the foregoing plug 224 to allow the user to replenish laundry detergent through the removal of the plug 224 without removing the storage container lid portion 221*b*, 222*b*. In addition, a front end of each of the storage container cover portion 221*b*, 222*b* may be disposed with a protrusion 222*b'* configured to protrude toward the front portion, thereby allowing the user to hold it to more easily remove the storage container cover portion 221*b*, 222*b*.

Moreover, as shown in FIG. 3A, the first storage container 210 and the second storage container 220 may be mounted at one side of the housing to face each other, and thus the manual detergent dispensing unit 223' may be disposed between the first storage container 210 and the second storage container 220, thereby allowing the user to manually put laundry detergent therein.

Besides, the manual detergent dispensing unit 223' may be configured to mount a third storage container 223 so as to guide the input of laundry detergent by the user, and the third storage container 223 may be divided into two regions through a boundary portion defined at a center portion thereof, thereby allowing the user to put fabric softener to one side, and to put detergent to the other side as a manual mode.

Figure 4A:
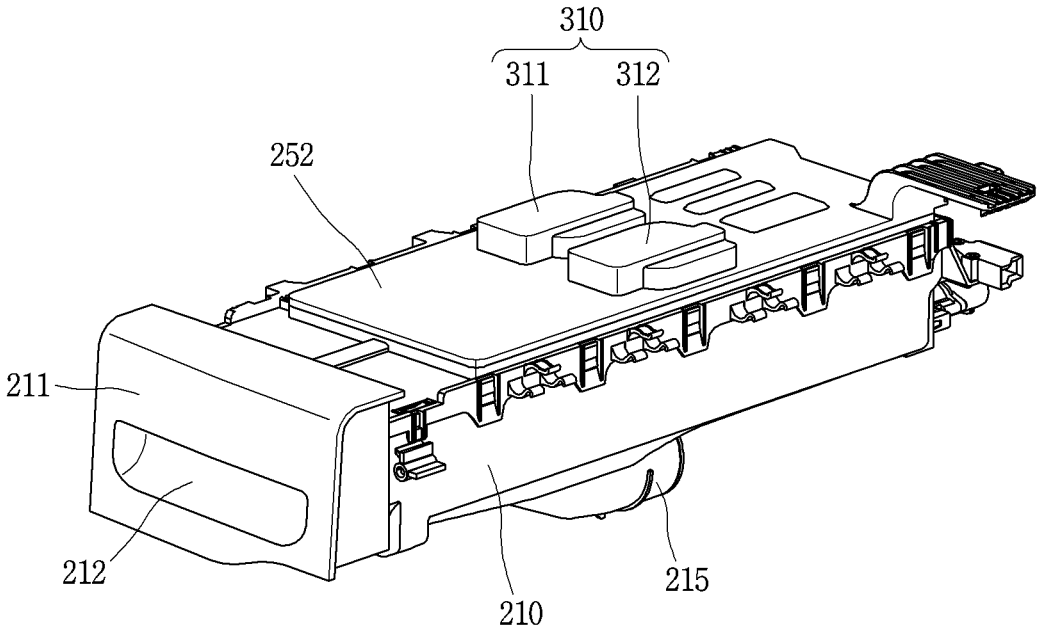
FIG. 4A is a conceptual view showing a state in which the detergent supply apparatus is inserted into the main body.
Figure 4B:
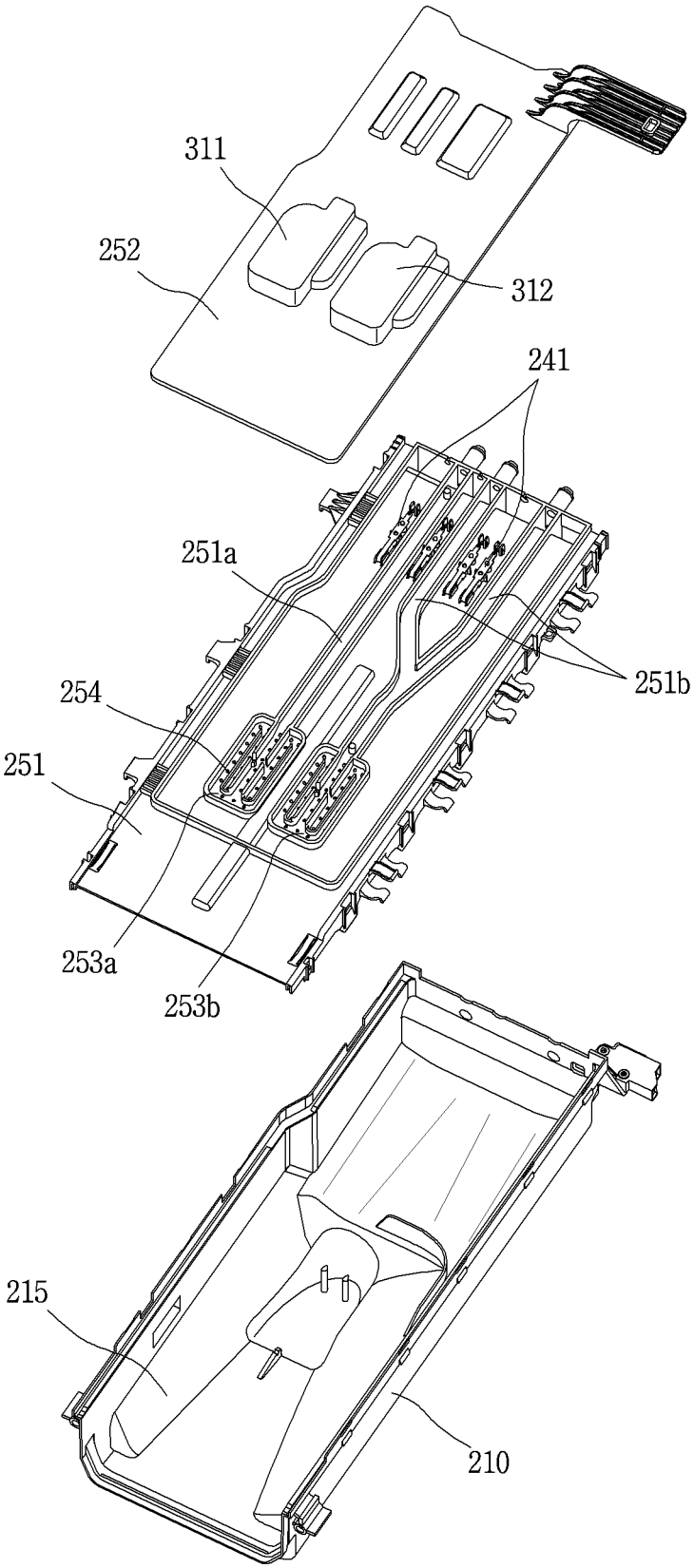
FIG. 4B is an exploded view of the detergent supply apparatus in a state where a storage container is removed in FIG. 4A.

FIG. 4A is a conceptual view showing a state in which the detergent supply apparatus 200 is inserted into the main body 110, and FIG. 4B is an exploded view of the detergent supply apparatus 200 in a state where the storage containers 221, 222 are removed in FIG. 4A.

A wash water dispenser 250 may be fixedly provided at the main body 110 of the laundry treatment apparatus 100. When the housing 210 is inserted into the main body, the wash water dispenser 250 may be located above the housing 210.

The wash water dispenser 250 serves to define a moving path of wash water flowing therein. When the housing 210 is mounted to the main body 110, the wash water dispenser 250 provided inside the main body 110 may be located to face each storage container 221, 222 mounted to the housing 210.

The wash water dispenser 250 may include a dispenser cover 251 and a dispenser lid 252 disposed to cover the dispenser cover 251.

The dispenser cover 251 may be disposed with wash water passages 251*a*, 251*b* extending in a predetermined shape along the surface to guide the movement of wash water flowing in along a wash water inlet portion 251*c*, 251*c'*.

The wash water passages 251*a*, 251*b* may be disposed on a rear surface of the dispenser cover 251 to communicate with the wash water inlet portions 251*c*, 251*c'* passing through the inside and the outside so as to allow wash water to flow therein. The wash water passages 251*a*, 251*b* may be defined by both sidewalls extending along one direction at a predetermined height. When the dispenser lid 252 is coupled to the dispenser cover 251, it may be defined a closed space allowing wash water to move, thereby allowing wash water to move toward each wash water receiving portion 253*a*, 253*b* along the wash water passage 251*a*, 251*b*.

As shown in FIG. 4B, the wash water passages 251*a*, 251*b* may be configured in plurality. Each of the wash water passages 251*a*, 251*b* may extend toward each of the wash water receiving portions 253*a*, 253*b* disposed at one side surface of the dispenser cover 251.

The wash water passage 251*a*, 251*b* may include a first wash water passage 251*a* and a second wash water passage 251*b*. The first wash water passage 251*a* may communicate with one wash water inlet portion 251*c* to allow wash water to flow therein. The first wash water passage 251*a* may guide the movement of the wash water toward the first wash water receiving portion 253*a*.

The first wash water receiving portion 253*a* may be provided with a space in which wash water temporarily moving along the first wash water passage 251*a* is temporarily received. A plurality of wash water moving holes 254 may be disposed in the first wash water receiving portion 253*a*, and wash water received in the first wash water receiving portion 253*a* may be discharged through the wash water moving hole 254.

In addition, the second wash water receiving portion 253*b* may be disposed at a position adjacent to the first wash water receiving portion 253*a* to communicate with the second wash water passage 251*b*, thereby implementing a movement of wash water.

The detergent input hole 214 may be disposed at a lower center portion of the housing 210. The detergent input hole 214 may be configured to communicate with the tub (not shown) of the laundry treating apparatus 100, and thus laundry detergent mixed with wash water may be moved toward the detergent input hole 214 and then supplied to the tub (not shown).

As shown in FIG. 4A, the dispenser lid 252 may be provided to cover the dispenser cover 251, and the motor assembly 310 may be provided at an upper side of the dispenser lid 252. The motor assembly 310 serves to transfer a driving force by generating a rotational force of a motor, and as shown in FIG. 4A, the motor assembly 310 may include a first motor assembly 310*a* and a second motor assembly 310*b*. A driving force obtained through the first motor assembly 310*a* and the second motor assembly 310*b* becomes motive power for operating the pump module 320 which will be described later.

Furthermore, the laundry detergent pump 300 provided at one side of the storage containers 221, 222 may suck laundry detergent stored in the storage containers and then discharge the laundry detergent to a lower side of the housing.

The laundry detergent may be directly injected into the housing 210 by the laundry detergent pump 300.

As shown in FIG. 4B, an inclined portion 215 having a predetermined inclination may be disposed at a lower surface portion of the housing 210 to face the detergent input hole 214. The laundry detergent pump 300 may be provided at a rear portion of the housing 210 to define a movement of laundry detergent stored in the storage containers 221, 222.

One side of each storage container 221, 222 may be respectively provided with the laundry detergent pump 300, and the stored laundry detergent may be supplied into the housing 210 by the operation of the laundry detergent pump 300, and mixed with wash water received in the laundry receiving portions 253*a*, 253*b* of the dispenser 250 and supplied to the tub (not shown) through the detergent input hole 214.

When the housing 210 is inserted and positioned into the main body 110, the first wash water receiving portion 253*a* and the second wash water receiving portion 253*b* may be overlapped in a vertical direction with one partitioned region of the third storage container 223 provided in the manual detergent dispensing unit 223' of the housing 210.

When liquid detergent is put into the third storage container 223, wash water received in the first wash water receiving portion 253*a* may be mixed with the liquid detergent and then supplied to the tub while moving downward through the wash water moving hole 254.

When the housing 210 is inserted into the main body 110, the second wash water receiving portion 253*b* may be located to overlap with another partitioned region of the third storage container 223 provided in the manual detergent dispensing unit 223' of the housing 210 in a vertical direction.

When fabric softener is put into the third storage container 223, wash water and fabric softener moving downward through a plurality of wash water moving holes 254 disposed in the second wash water receiving portion 253*b* may be mixed with each other and supplied toward the tub.

The dispenser lid 252 may have a rectangular plate shape, and may be coupled to the dispenser cover 251. When the dispenser lid 252 is coupled to the dispenser cover 251, each of the wash water passages 251*a*, 251*b* disposed in the dispenser cover 251 may be closed.

Figure 5A:
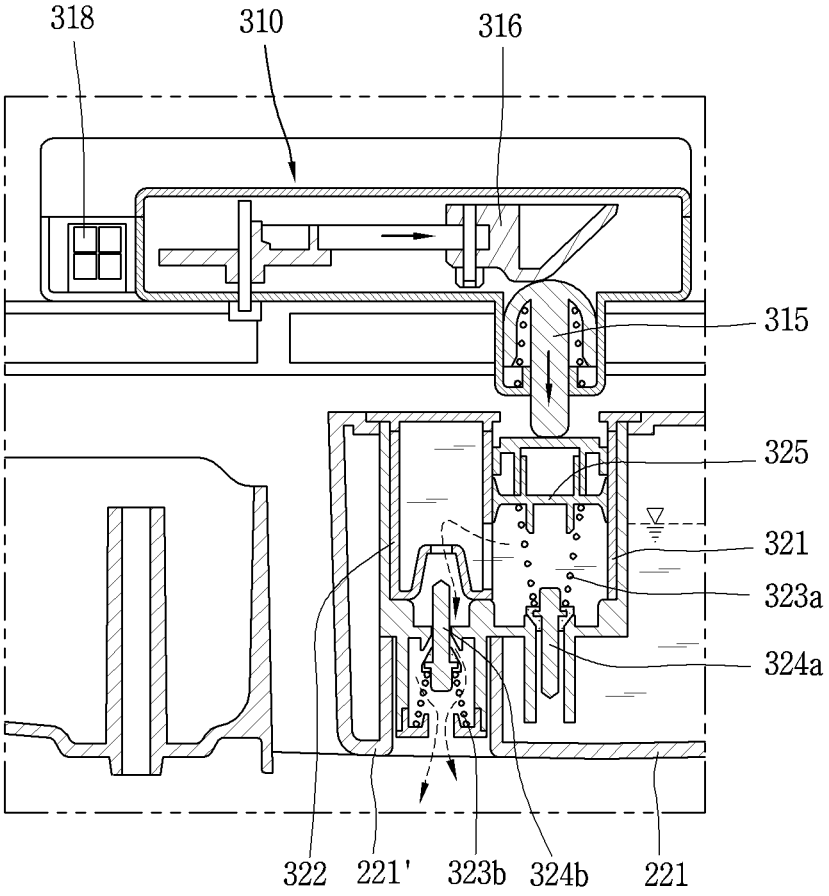
FIGS. 5A and 5B are conceptual views each showing an operation state of a laundry detergent pump.
Figure 5B:
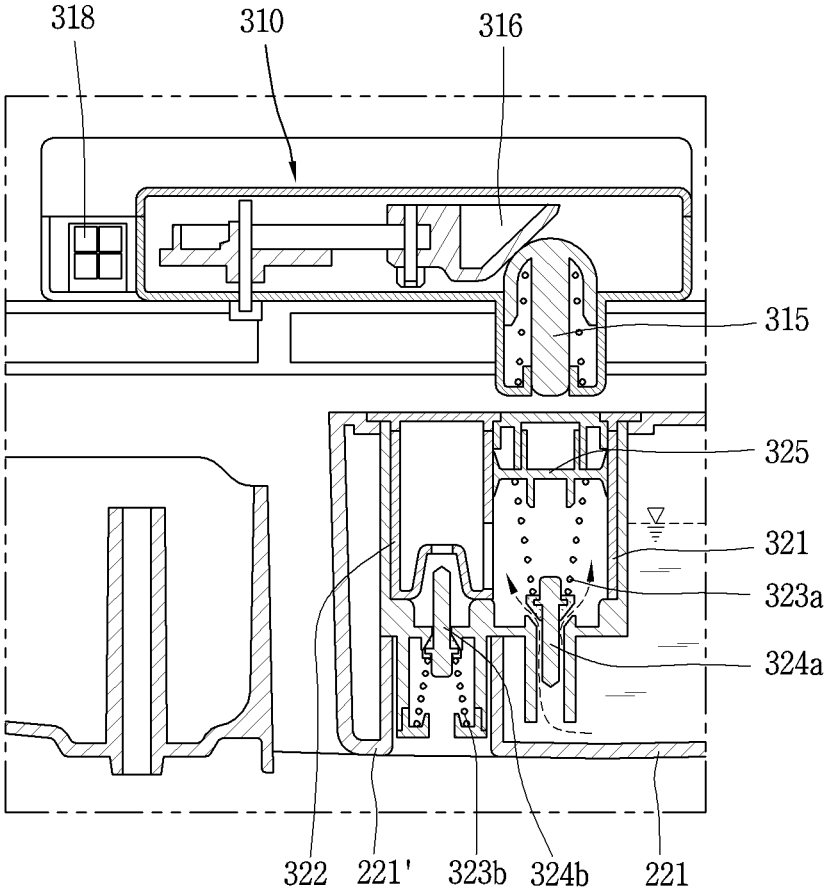

FIGS. 5A and 5B are conceptual views each showing an operation state of the laundry detergent pump 300.

The laundry detergent pump 300 may include a motor assembly 310 and a pump module 320. When a driving force generated by the motor assembly 310 acts on the pump module 320, laundry detergent received in the storage container may be supplied to the tub through the pump module 320 provided at one side of the storage container 221.

The pump module 320 may be provided to be coupled to one side of the storage container 221 in which laundry detergent is received. In order to define the movement of laundry detergent stored in the storage container 221, one side of the pump module 320 may be located adjacent to a lower surface portion of the storage container 221.

Looking into the pump module 320, the pump module 320 may include a first cylinder 321 defined in a cylindrical shape and positioned to be received in the storage container 221, and a second cylinder 322 disposed in parallel to the first cylinder, one side of which communicates with the first cylinder 321 to receive laundry detergent flowing in along the first cylinder and discharge the laundry detergent to a lower portion of the housing.

A disc-shaped sliding plate 325 elastically supported by a first spring 323*a* having an elastic force may be provided inside the first cylinder 321, and the sliding plate 325 may vertically slide according to the movement of a vertical movement member 317.

When the motor assembly 310 is operated, the movement of a cam head 316 may be generated. Through the movement of the cam head 316, a vertical movement of the vertical movement member 317 may be generated, and the vertical movement member 317 may pressurize the pump module 320 to move laundry detergent stored in the storage container.

As shown in FIG. 5A, when the vertical movement member 317 moves downward, pressure may be applied downward toward the pump module 320. In this case, the downward pressurization may move the sliding plate 325 in a downward direction. At this time, the sliding plate 325 may apply pressure toward laundry detergent received in the first cylinder 321, and thus movement of laundry detergent may be carried out toward an inside of the second cylinder 322, one side of which communicates with the first cylinder 321.

At this time, a second valve member 324*b* provided inside the second cylinder 322 may open the passage while moving downward, and in this case, laundry detergent may move to a lower portion of the housing 210. The laundry detergent moving to the lower portion of the housing 210 may be mixed with wash water to be supplied to the tub.

FIG. 5B is a conceptual view showing a state when the vertical movement member 317 is moved upward.

When pressure applied to the pump module 320 by the vertical moving member 317 is removed, the sliding plate 325 may move upward by the first spring 323*a*. In this case, the passage may be open while a first valve member 324*a* provided in the first cylinder 321 moves upward, and laundry detergent received in the storage container may flow into the first cylinder according to the movement of the first valve member 324*a*. At this time, the passage may be closed by an elastic force by the second spring 323*b* provided in the second cylinder while the second valve member 324*b* is pressurized upward, and the discharge of wash water through a pump module installation portion 221' disposed at a lower portion of the housing 210 may not be carried out.

Figure 6A:
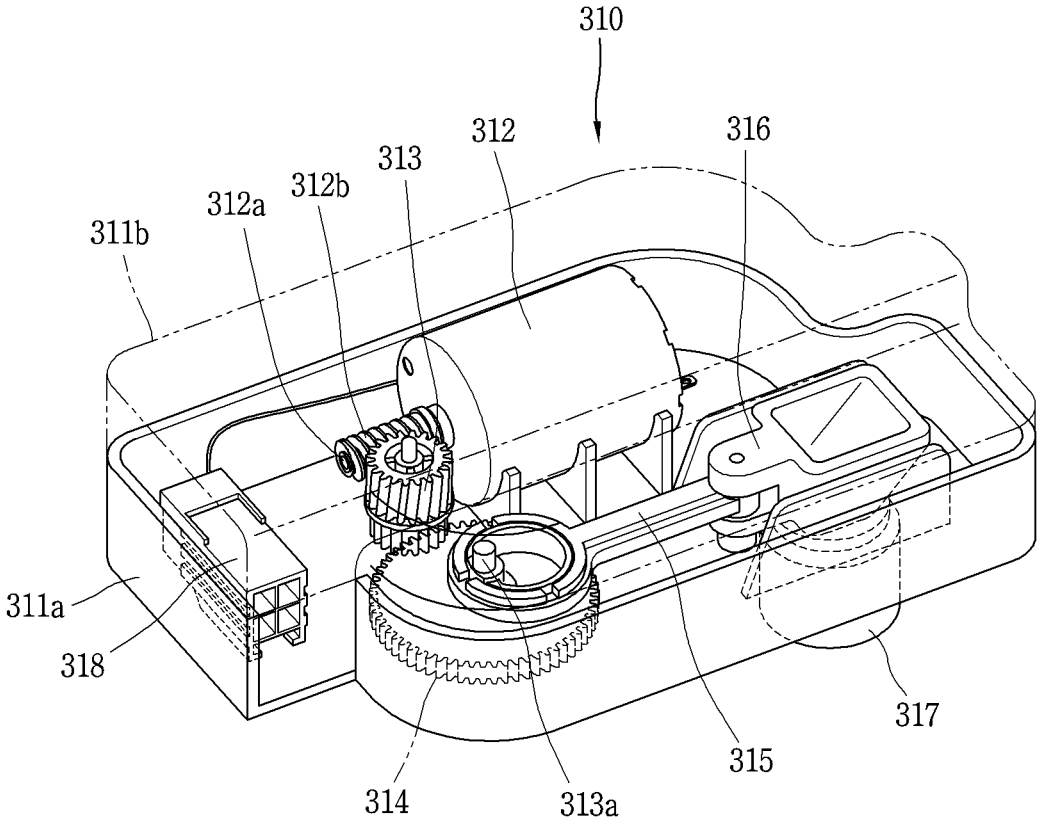
FIG. 6A is a perspective view of a motor assembly.
Figure 6B:
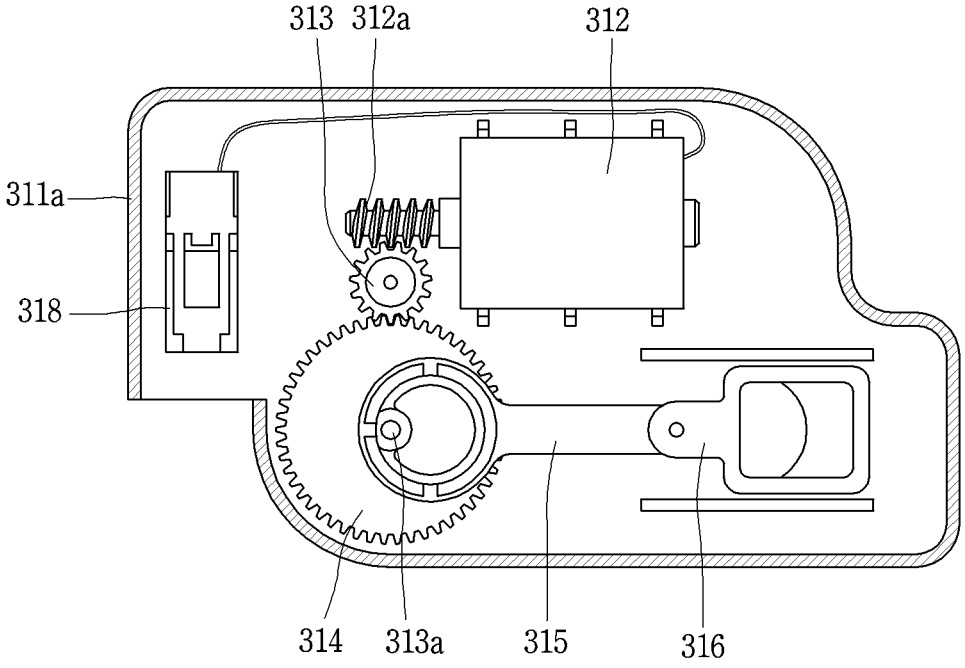
FIG. 6B is a cross-sectional view showing an internal structure of the motor assembly.

FIGS. 6A and 6B are conceptual views showing an internal structure of a motor assembly.

The motor assembly 310 may be provided on one upper side of the wash water dispenser 250 to transmit a driving force.

Looking into an internal structure of the motor assembly 310, the motor assembly 310 may include a case 311*a*, a case lid 311*b*, a motor 312, a direction change gear 313, a reduction gear 314, a crankshaft 315, and a vertical movement member 317.

The case 311*a* may define an outer appearance of the motor assembly 310 so that a space having a predetermined volume may be defined therein. The case cover 311*b* may be coupled to an upper side of the case 311*a* to define a closed space.

The motor 312 is provided inside the case 311*a* to perform the role of generating a rotational force. When power is supplied to the motor through a power input terminal unit 318 provided inside the case 311*a*, the motor 312 may be rotated in one direction.

The teeth are made on an outside of the direction change gear 313, and provided to engage with a rotation shaft of the motor 312 so as to change the direction of the rotational force.

The reduction gear 314 may be configured to rotate in engagement with the teeth of the direction change gear 313.

One end of the crankshaft 315 is fixedly provided at the reduction gear 314 to generate a reciprocating motion of the cam head 316 coupled to one side thereof through a rotational force generated by the reduction gear 314.

The cam head 316 coupled to the other side of the crankshaft 315 may generate a vertical movement of the vertical movement member 317 as the crankshaft 315 reciprocates.

The cam head 316 may be disposed to protrude to face the vertical movement member.

The vertical movement member 317 may be provided at a lower portion of the cam head 316 to enable vertical movement while in contact with a lower end portion of the cam head 316.

As a result, as illustrated in FIGS. 5A and 5B, the pump module 320 may be pressurized by the vertical movement of the vertical movement member 317. When the pump module is pressurized through the vertical movement member 317, the movement of laundry detergent received in the first and second cylinders 321, 322 located inside the pump module 320 may be carried out while the sliding plate 325 moves downward, and as a result, laundry detergent received in the storage container 221 may be supplied to the tub in this manner.

The foregoing description is merely embodiments for implementing a laundry treating apparatus according to the present disclosure, and the present disclosure is not limited to the above embodiments, and various modifications and improvements will become apparent to those skilled in the art without departing from the concept and scope of the present disclosure as disclosed in the following claims.

What is claimed is:

1. A laundry treating apparatus, comprising:

a main body;

a tub located inside the main body;

a drum located inside the tub and configured to rotate; and a detergent supply apparatus that is located at one side of the main body, that is configured to supply laundry detergent to the tub, and that is configured to be inserted into or withdrawn from a front surface of the main body, the detergent supply apparatus comprising:

a housing defining an outer appearance of the detergent supply apparatus;

a storage container that extends in a front-rear direction inside the housing and that is configured to store the laundry detergent;

a laundry detergent pump located at a side of the storage container, and configured to suction laundry detergent stored in the storage container and discharge the laundry detergent to a lower side of the housing; and a wash water dispenser located inside the main body and above the housing based on the housing being inserted into the main body, wherein a bottom surface of the wash water dispenser faces an upper portion of the storage container and defines a moving path of wash water flowing in the detergent supply apparatus, wherein the laundry detergent pump comprises:

a motor assembly located at an upper side of the wash water dispenser and configured to transmit a driving force, and a pump module located at the side of the storage container and configured to pump laundry detergent stored in the storage container by the driving force transmitted by the motor assembly, wherein the motor assembly comprises:

a motor configured to generate a rotational force, and a vertical movement member that is configured to enable vertical movement by receiving the rotational force of the motor and that is configured to pressurize the pump module by the vertical movement, wherein the pump module comprises:

a first cylinder that has a cylindrical shape and that is located in the storage container, a second cylinder that is located in parallel to the first cylinder, that has a first side that is in fluid communication with the first cylinder, and that is configured to receive laundry detergent flowing along the first cylinder and discharge the received laundry detergent to a lower portion of the housing, and a sliding plate that is elastically supported by a first spring and that is located inside the first cylinder, and wherein, based on the pump module being pressurized by the vertical movement member, the sliding plate is configured to move laundry detergent received in the first cylinder toward the second cylinder while moving downward.

2. The laundry treating apparatus of claim 1, wherein the storage container comprises a first storage container and a second storage container that face each other at one side of the housing, and wherein a manual detergent dispensing unit is disposed between the first and second storage containers and configured to enable manual supply of laundry detergent.

3. The laundry treating apparatus of claim 2, wherein a third storage container is located on the manual detergent dispensing unit and configured to guide the supply of laundry detergent.

4. The laundry treating apparatus of claim 1, wherein the housing comprises a lower surface portion that is inclined to move the laundry detergent, and a detergent input hole disposed at a lower surface of the housing and configured to communicate between the detergent supply apparatus and the tub.

5. The laundry treating apparatus of claim 1, further comprising a discharge port located at a rear portion of the storage container and configured to discharge stored laundry detergent by operation of the laundry detergent pump, wherein the laundry detergent flowing out through the discharge port is mixed with incoming wash water, and moved toward the tub.

6. A laundry treating apparatus, comprising:

a main body;

a tub located inside the main body;

a drum located inside the tub and configured to rotate; and a detergent supply apparatus that is located at one side of the main body, that is configured to supply laundry detergent to the tub, and that is configured to be inserted into or withdrawn from a front surface of the main body, the detergent supply apparatus comprising:

a housing defining an outer appearance of the detergent supply apparatus;

a storage container that extends in a front-rear direction inside the housing and that is configured to store the laundry detergent;

a laundry detergent pump located at a side of the storage container, and configured to suction laundry detergent stored in the storage container and discharge the laundry detergent to a lower side of the housing; and a wash water dispenser located inside the main body and above the housing based on the housing being inserted into the main body, wherein a bottom surface of the wash water dispenser faces an upper portion of the storage container and defines a moving path of wash water flowing in the detergent supply apparatus, wherein the laundry detergent pump comprises:

a motor assembly located at an upper side of the wash water dispenser and configured to transmit a driving force, and a pump module located at the side of the storage container and configured to pump laundry detergent stored in the storage container by the driving force transmitted by the motor assembly, and wherein the motor assembly comprises:

a case having a space defined therein, a motor located inside the case and configured to generate a rotational force, a direction change gear configured to engage with a rotation shaft of the motor to change a direction of the rotational force, a reduction gear configured to rotate in engagement with teeth of the direction change gear, and a crankshaft having a first end located at the reduction gear and configured to generate a reciprocating motion of a cam head coupled to a second side of the crankshaft by a rotational force generated by the reduction gear.

7. The laundry treating apparatus of claim 6, further comprising:

a vertical movement member located at a lower portion of the cam head and configured to enable vertical movement while it is in contact with a lower end portion of the cam head, wherein the pump module is pressurized by the vertical movement of the vertical movement member.

8. The laundry treating apparatus of claim 7, wherein the pump module comprises:

a first cylinder that has a cylindrical shape and that is located in the storage container, and a second cylinder that is located in parallel to the first cylinder, that has a first side that communicates with the first cylinder, and that is configured to receive laundry detergent flowing along the first cylinder and discharge the received laundry detergent to a lower portion of the housing.

9. The laundry treating apparatus of claim 8, further comprising a sliding plate elastically supported by a first spring and located inside the first cylinder, wherein, based on the pump module being pressurized by the vertical movement member, the sliding plate is configured to move laundry detergent received in the first cylinder toward the second cylinder while moving downward.

10. The laundry treating apparatus of claim 9, wherein the sliding plate is configured to move, based on a pressurization due to the vertical movement member being removed, a first valve member located in the first cylinder upward while being moved upward by the first spring.

11. The laundry treating apparatus of claim 9, further comprising a second valve member located inside the second cylinder and configured to open a passage to move the laundry detergent while moving downward.

* * * * *